United States Patent [19]

Capoccia

[11] 4,226,477

[45] Oct. 7, 1980

[54] DEVICE FOR REMOVING THE EARTH GENERATED BY TUNNELING

[76] Inventor: Anastascio Capoccia, 48001 West Rd., Wixom, Mich. 48096

[21] Appl. No.: 2,355

[22] Filed: Jan. 10, 1979

[51] Int. Cl.[2] ..... E21C 35/20; E21D 9/12

[52] U.S. Cl. ..... 299/56; 175/62; 175/88; 198/594; 198/518

[58] Field of Search ..... 299/56, 57; 37/189; 175/62, 88, 122; 198/518, 594, 608

[56] References Cited

U.S. PATENT DOCUMENTS

| | | | |
|---|---|---|---|
| 1,220,527 | 3/1917 | Martin | 175/88 |
| 1,326,480 | 12/1919 | Dana | 299/56 |
| 2,165,666 | 7/1939 | Tilly | 175/122 |
| 3,506,310 | 4/1970 | Gruere | 299/56 |
| 4,059,163 | 11/1977 | Stedman | 175/88 |

*Primary Examiner*—Ernest R. Purser

*Attorney, Agent, or Firm*—Basile, Weintraub & Hanlon

[57] ABSTRACT

A device for removing the earth generated while tunneling to install conduit, pipe or the like. The earth removed from the tunnel is conveyed to the surface as it is generated. The apparatus includes a first auger-conveyor disposed at the side of the tunneling machine having a tray for catching the loose dirt from the tunneling operation as the tunneling advances, and a plurality of inlet apertures along the outer wall of the conveyor to ingest the loose dirt generated. A second auger-conveyor consumes the discharge of the first conveyor translating the loose dirt to the surface.

8 Claims, 4 Drawing Figures

DEVICE FOR REMOVING THE EARTH GENERATED BY TUNNELING

BACKGROUND OF THE INVENTION

I. Field of the Invention

The present invention relates generally to the field of earth boring machines, and in particular to the field of moving the earth excavated from a bored hole to the surface.

II. Prior Art Statement

U.S. Pat. Nos. 3,415,329; 3,767,836; and 3,851,716 were studied by the inventor as art remotely related to the present invention. None of the above referenced patents, however, disclose a means for translating the earth from a bored hole to the surface. The inventor is unaware of any other related prior art.

SUMMARY OF THE INVENTION

It is the purpose of the present invention to allow boring of a tunnel beneath the earth in a more timely and efficient manner by providing a device for the movement of the earth removed from a bored hole to the surface as the loose earth is generated.

The present invention which will be described in greater detail hereinafter, comprises a first conveyor having a multiplicity of inlets along its length. The conveyor moves the loose earth horizontally from the boring machine as it advances toward the hole being bored. A second conveyor moves the loose earth vertically out of the excavation pit to the surface, depositing it in an area where it can be conveniently disposed.

Other objects, advantages and applications of the present invention will become apparent to those skilled in the art of tunneling when the accompanying description of one example of the best mode contemplated for practicing the invention is read in conjunction with the accompanying drawings.

BRIEF DESCRIPTION OF THE DRAWINGS

The description herein makes reference to the accompanying drawings wherein like reference numbers refer to like parts throughout the several views, and wherein.

DESCRIPTION OF THE PREFERRED EMBODIMENT

Figure 1:
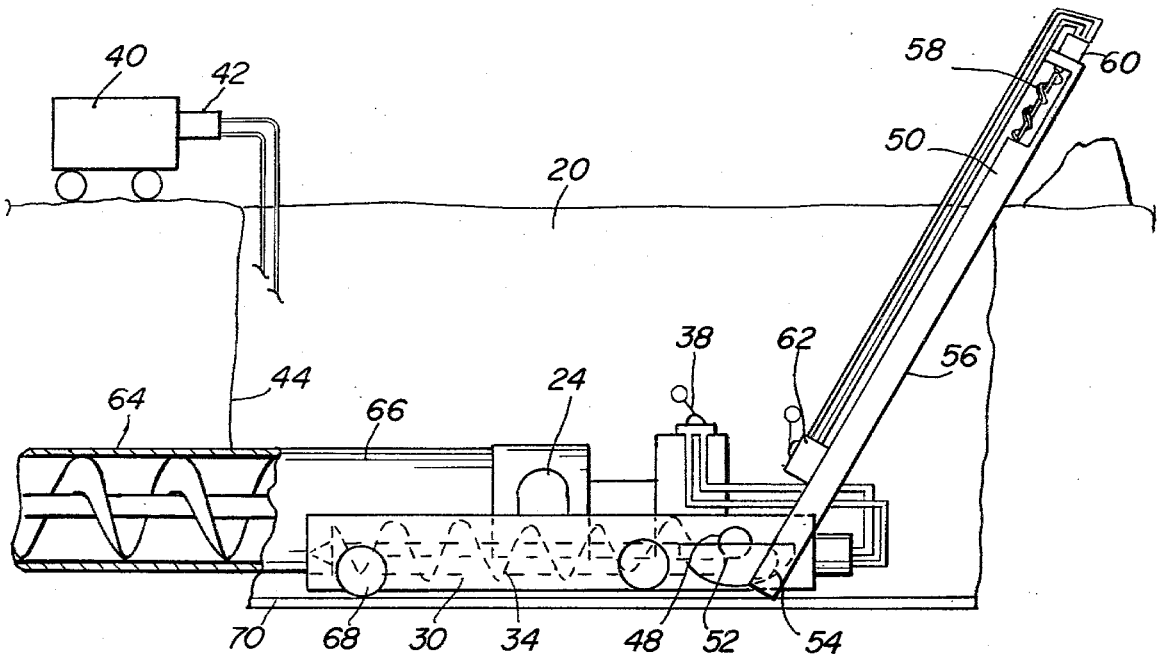
FIG. 1 is a side elevational view of a typical tunneling operation incorporating one example of the present invention.
Figure 2:
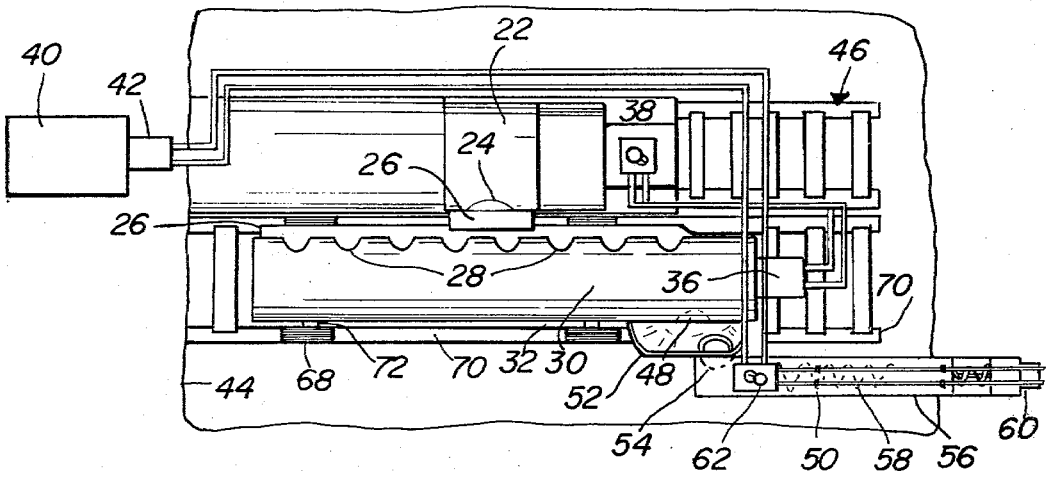
FIG. 2 is a top plan view of the tunneling operation illustrated in FIG. 1.
Figure 3:
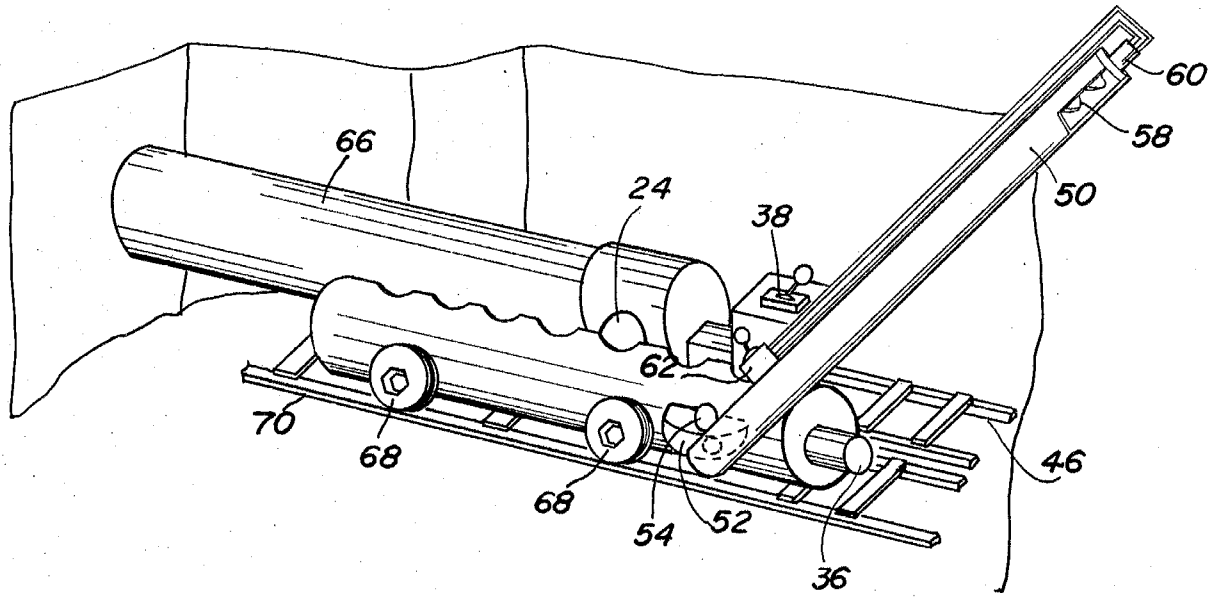
FIG. 3 is a perspective view of FIG. 1 looking from the surface into the excavation pit.

Referring, now, to the drawings, and in particular to FIGS. 1 and 2 wherein there is illustrated a preferred embodiment of the present invention in the form of a conveyor system 20. The system 20 includes a tunneling machine 22 which discharges the loose earth from the tunneling operation through its discharge opening 24. The loose earth falls into a tray 26 for guiding the earth into a multiplicity of inlet apertures 28 in a first conveyor 30. The first conveyor 30 comprises a horizontal cylinder 32 for its exterior which rotatably supports an auger 34. The apertures 28 are spaced apart a distance equal to the pitch of the auger 34, and have a diameter equal to one half the pitch of auger 34. The auger 34 is rotated by means of a hydraulic motor 36 which is started, stopped and reversed by means of a hydraulic 4-way valve 38. Hydraulic power is generated by a prime mover 40 which drives a hydraulic pump 42. The first conveyor discharges the loose earth through the first discharge aperture 48 which is an opening in the end of the horizontal cylinder 32. As the tunneling machine 22 bores deeper it moves toward the work face 44 moving on a pair of rails 46 and the discharge opening 24 moves along the multiplicity of first input apertures 28. The loose earth discharged by the first discharge aperture 48 drops into a hopper 52 which directs the loose earth into a second input aperture 54 at the lower end of a second conveyor 50. The second conveyor has its lower end disposed below the output aperture 48 of the first conveyor, and its upper end is disposed at a point above ground level at a convenient location for disposing of the loose earth. The second conveyor 50 comprises a second cylinder 56 which rotatably supports a second auger 58. A second hydraulic motor 60 rotatably drives the second auger 58 and derives its power from the hydraulic 4-way valve 62 which controls the flow of hydraulic fluid to the hydraulic motor 60 so that the auger 58 can be started, stopped and reversed.

When the tunneling machine 22 reaches the work face 44 it is stopped and moved away from the work surface 44 along a first pair of spaced apart rails 46. This spaces the end of a drilling auger 64 a distance from the work surface 44 allowing another length of drilling auger 64 and conduit 66 to be installed so that tunneling can proceed. The first conveyor means 30 has a pair of spaced apart wheels 68 attached to the bottom of the horizontal tube 32 by means of a pair of axles 72. The wheels 68 rest upon a second pair of spaced apart rails 70 allowing the first conveyor means 30 to be moved along the pair of rails 70 spacing the first conveyor apart from the work face 44. This allows full access to the work face 44 during the installation of another length of drilling auger 64 and conduit 66. When the new length of drilling auger 64 has been properly installed with the new length of conduit 66 and coupled to the forward length of drilling auger 64, the first conveyor means 30 is moved horizontally along its pair of rails 70 to the work face 44 and the tunneling operation is again commenced.

It is an object of this invention to provide a means to continuously remove the loose earth generated by a tunneling operation to the surface as it is generated. It is a further object of this invention to keep the excavation free of loose earth and moistened loose earth or mud. The mud must be removed as it is generated or it will spread over the bottom surface of the excavation where it is difficult and costly to remove using a conventional back hoe or the like. In a conventional tunneling operation, when mud accumulates in the excavation above the level of the rails, the tunneling must be stopped, sometimes for many days, to allow the mud to dry so it can be scooped out by conventional means. In the present invention, using auger conveyors, the mud is removed to the surface as it leaves the tunneling machine and the excavation is kept dry allowing the tunneling to continue without interruption even during inclimate weather.

It is readily understood by those skilled in the art of tunneling that other embodiments of the preferred configuration could be used to advantage in certain circumstances where in three or more conveyors for translating the loose earth may be advantageous, or the use of a prime movers directly coupled to the conveyors may be preferred.

The tunneling machine 22 can be either directly coupled to a prime mover or it can be remotely powered by a hydraulic motor deriving power from the hydraulic pump 42, or a second prime mover and pump.

Figure 4:
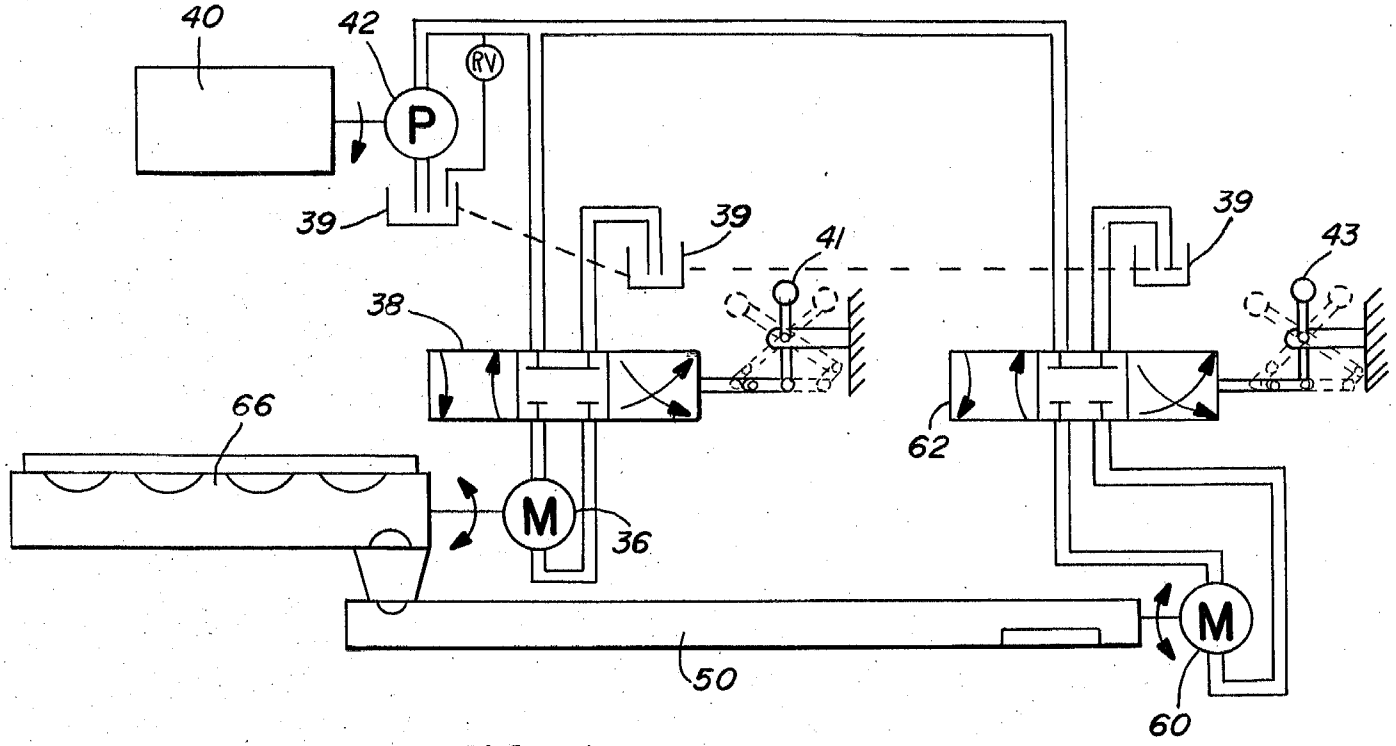
FIG. 4 is a hydraulic circuit for the apparatus 20.

FIG. 4 illustrates the hydraulic circuit for the preferred embodiment. Prime mover 40, which can be either an internal combustion engine or an electric motor, drives a hydraulic pump 42 which draws fluid from the reservoir 39. The discharge of the pump 42 is directed to a manually actuated 4-way valve 38 and another manually activated 4-way valve 62.

Valve 38 directs fluid to a reversable hydraulic motor 36 which drivingly engages the first conveyor 66. Valve 38 in its center position stops the motor 36 and redirects the oil flow to the reservoir 39. When a lever 41 is moved to the left of center the motor 36 rotates forward. When the lever 41 is moved to the right the motor 36 rotates in reverse. Reverse may sometimes be required to unclog the conveyor.

The valve 62 functions in the same manner as valve 38 to drive a reversable motor 60 which drivingly engages a second conveyor 50. A lever 43 is used to stop or drive forward or reverse the second conveyor 50.

Having, thus, described the preferred embodiment of my invention, what I claim is:

1. A device for removing the loose earth generated by a tunneling means comprising:

said tunneling means having a discharge aperture disposed at one end thereof;

a first conveyor means for receiving and conveying said loose earth generated by said tunneling means, said first conveyor means having a multiplicity of first input apertures disposed opposite the path of said discharge aperture of said tunneling means such that successive ones of said first input apertures are disposed in proximity with said discharge aperture of said tunneling means to receive loose earth therefrom as said tunneling means advances; and a second conveyor means for consuming said loose earth from first conveyor means and translating said loose earth to a receiving area.

2. A device for removing the loose earth generated by a tunneling means as defined in claim 1 wherein said first conveyor means rests on rails; wheel means disposed between said first conveyor means and said rails allowing said first conveyor means to be horizontally removed from the work face of the tunnel and thereby allowing access to the tunnel face for the joining of additional tunnel conduit and drilling augers as the tunneling advances.

3. A device for removing the loose earth generated by a tunneling means as defined in claim 1 wherein said first conveyor means comprises a horizontal tube, a first auger rotatably supported in said horizontal tube, a plurality of first apertures disposed along the side of said horizontal tube, a first trough disposed along the lowermost point of said apertures, said first trough directing the earth generated by said tunneling means into said first apertures, a first discharge apertures for discharging said earth, a means for rotating said first auger, and a means for starting, stopping and reversing the rotation of said first auger.

4. A device for removing the earth generated by a tunneling means as defined in claim 3 wherein said means for rotating said first auger is a first hydraulic motor, and said means for starting, stopping and reversing the rotation of said first auger is a first hydraulic directional valve.

5. A device for removing the earth generated by a tunneling means as defined in claim 3 wherein the spacing of said first apertures equals the pitch of said first auger.

6. A device for removing the earth generated by a tunneling means as defined in claim 1 wherein said second conveyor means comprises an outer tube, a second auger rotatably supported by said outer tube, a second input disposed immediately below said first discharge aperture, a second discharge aperture, a second means for rotating said second auger, and a second means for starting, stopping and reversing the rotation of said second auger.

7. A device for removing the earth generated by a tunneling means as defined in claim 6 wherein said second means for rotating said second auger is a second hydraulic motor, and said second means for starting, stopping and reversing the rotation of said second auger is a second hydraulic directional valve.

8. A device for removing the earth generated by a tunneling means as defined in claim 1 comprising a hydraulic means for horizontally moving said first conveyor means.

* * * * *